US010813389B2

(12) United States Patent
Mahoney

(10) Patent No.: US 10,813,389 B2
(45) Date of Patent: Oct. 27, 2020

(54) PACKABLE GARMENT SYSTEM AND RELATED METHOD

(71) Applicant: Saucony, Inc., Waltham, MA (US)

(72) Inventor: Christopher J. Mahoney, Concord, MA (US)

(73) Assignee: Saucony, Inc., Watham, MA (US)

( * ) Notice: Subject to any disclaimer, the term of this patent is extended or adjusted under 35 U.S.C. 154(b) by 339 days.

(21) Appl. No.: 15/984,946

(22) Filed: May 21, 2018

(65) Prior Publication Data

US 2019/0350277 A1 Nov. 21, 2019

(51) Int. Cl.

| | |
|---|---|
| ***A41D 3/00*** | (2006.01) |
| ***A45F 4/12*** | (2006.01) |
| ***A41D 15/04*** | (2006.01) |
| ***A41D 3/04*** | (2006.01) |

(52) U.S. Cl.

CPC ..... *A41D 3/005* (2013.01); *A41D 3/04* (2013.01); *A41D 15/04* (2013.01); *A45F 4/12* (2013.01)

(58) Field of Classification Search

CPC ..... A41D 3/005; A41D 3/04; A41D 15/04; A45F 4/12

USPC ..... 2/108

See application file for complete search history.

(56) References Cited

U.S. PATENT DOCUMENTS

| | | | | |
|---|---|---|---|---|
| 2,058,474 A | | 10/1936 | Long | |
| 4,227,264 A | * | 10/1980 | Spector | A41D 15/00 2/84 |
| 4,404,687 A | * | 9/1983 | Hager | A41D 3/005 2/94 |
| D277,049 S | | 1/1985 | Peyser | |
| 5,787,504 A | * | 8/1998 | Wu | A41D 15/04 2/93 |
| 5,850,634 A | * | 12/1998 | Toombs | A41D 15/04 2/93 |
| 5,996,121 A | * | 12/1999 | Harris | A41D 15/04 2/108 |
| 6,405,377 B1 | * | 6/2002 | Davis | A41D 15/04 2/108 |
| 8,424,114 B2 | | 4/2013 | Snyder et al. | |
| 9,867,453 B1 | * | 1/2018 | Diaz | A41D 15/04 |
| 10,588,362 B1 | * | 3/2020 | Alexei | A45C 9/00 |
| 2010/0111448 A1 | * | 5/2010 | Li | A45C 9/00 383/4 |
| 2016/0157535 A1 | * | 6/2016 | Tirro | A41D 1/02 2/93 |
| 2017/0340032 A1 | * | 11/2017 | Lee | A45F 4/12 |

OTHER PUBLICATIONS

Brooks LSD Jacket, downloaded from http://www.brooksrunning.com/en_us/brooks-mens-lsd-running-jacket/211100.html on May 18, 2018.

* cited by examiner

*Primary Examiner* — Anne M Kozak

(74) *Attorney, Agent, or Firm* — Warner Norcross + Judd LLP

(57) ABSTRACT

A garment is provided including a back panel joined with a bag panel, and a closure strap. The back panel and bag panel can be used in a wearing mode while the garment is worn, then turned inside out into a stowed mode, when the garment is to be stowed, to form a stowage bag within which the garment can be stuffed, with the closure strap movable to a closing configuration to at least partially close an opening of the stowage bag and secure the garment inside the stowage bag. Related methods of use are also provided.

17 Claims, 8 Drawing Sheets

PACKABLE GARMENT SYSTEM AND RELATED METHOD

BACKGROUND OF THE INVENTION

The present invention relates to garments, and more particularly to a garment that includes a hidden pocket within which to stow and carry the garment when not being worn by a user.

When engaging in activities in the outdoors, it is common for a person to encounter a variety of environmental conditions. For example, a runner or other athlete can set off on a run or begin an athletic activity in the cool morning hours, and continue their activity well into a hot and humid late morning or afternoon. Some people address such a temperature change by donning a jacket or other garment in the morning hours, and then carrying the garment later in the day. In other cases, a person might engage on a hike or run in the afternoon, and in anticipation of changing weather, such as a cooler evening, will take with them in a bag or backpack, some sort of extra garment to wear after it cools. Changes in outer dress may also be necessitated by changing levels of personal exertion, health considerations and the like. The concept of layering clothing is a well-known technique used to ensure comfort despite changing environmental conditions, personal exertion, and other factors.

Where environmental or other circumstances necessitate removal and stowage of a garment, devices useful for carrying the garment in a small package are helpful. There are a variety of such devices. Some of those devices incorporate a backpack with straps built into a jacket. The straps are helpful, but add to the weight and bulk of the jacket. Other devices incorporate a zippered pocket in a front panel of a jacket. The jacket can be stuffed into the zippered pocket and then the pocket can be zipped closed to secure the jacket inside. While helpful, the zipper adds weight, and due to the extra stresses upon stuffing the jacket, can frequently break and give way, thereby no longer providing adequate enclosure for the stowed jacket.

Accordingly, there remains room for improvement in the field of garments that can include devices for stowing and carrying the garments when not in use.

SUMMARY OF THE INVENTION

A garment is provided including a back panel joined with a bag panel, and a closure strap. The back panel and bag panel can be used in a wearing mode while the garment is worn, then turned inside out into a stowed mode, when the garment is to be stowed, to form a stowage bag within which the garment can be stuffed, with the closure strap movable to a closing configuration to at least partially close an opening of the stowage bag and secure the garment inside the stowage bag.

In one embodiment, the garment can include first and second arm portions joined with the front panel and the back panel. The back panel can include a first back panel portion, that forms part of the stowage bag, and second back panel portion. The back panel can include a first back panel surface configured to face toward a wearer's posterior and a second back panel surface configured to face away from the wearer's posterior.

In another embodiment, the garment can include a bag panel located between the first and second arm portions, and optionally along a part of a longitudinal axis of the garment. The bag panel can include a bag panel surface configured to face toward the posterior and a second bag panel surface configured to face away from the posterior, the first back panel surface facing toward the second bag panel surface, when the bag panel is in the stowed mode.

In still another embodiment, the bag panel and the back panel are operable in a wearing mode and a stowed mode. The strap can be disposed in a first void defined between the bag panel and the back panel when those panels are in the wearing mode.

In a further embodiment, the bag panel and the back panel are turned inside out in the stowed mode. In this mode, these components can define a second void, with the second bag panel surface being a front exterior surface of a stowage bag. The first back panel surface can be a rear exterior surface of the stowage bag in this mode as well.

In still a further embodiment, in the stowed mode, the strap can extend over the front exterior surface of the stowage bag, while the stowage bag defines an opening. The second portion of the back panel, the first and second arm portions and the front panel can be stored inside the second void in the stowed mode.

In even a further embodiment, the strap can extend over the rear exterior surface of the stowage bag, and over the opening of the stowage bag so as to close the opening in the stowed mode.

In yet another embodiment, a method is provided. The method can include: providing a garment similar to those described above; engaging the bag panel and the back panel so as to turn the bag panel and the back panel inside out so as to define a second void, and to render the second bag panel surface a front exterior surface of a stowage bag, and to render the first back panel surface a rear exterior surface of the stowage bag, with the strap extending over the front exterior surface of the stowage bag, the stowage bag defining an opening; stuffing the garment into the second void; and reorienting the strap so that the strap extends over the rear exterior surface of the stowage bag, and over the opening of the stowage bag so as to at least partially close the opening.

In a further embodiment, the method can include closing the opening only with the strap extending over the upper edge and the opening of the stowage bag.

In still a further embodiment, the method can include placing a user's hand between the strap and the rear exterior surface of the stowage bag. In this manner the stowage bag can be carried by the user in one hand.

The current embodiments of the garment and related method of use provide benefits that previously have been unachievable. For example, with the bag panel joined directly with the back panel, the resulting stowage bag can be loaded relatively symmetrically with the remainder of the garment. Where the stowage bag is closed with the elongated strap, extra zippers, fasteners and other bulky closures can be eliminated to simplify the construction. In cases where the strap is elastic, and is placed over the rear exterior surface of the bag, the bag can be easily carried by a user inserting their hand between the strap and the rear exterior surface. Where included, the elongated strap can form the final and only closure after the garment has been packed. This strap also can serve as the element to assist in carrying around the garment, whether in the hand, on the arm, or attached to belt, pocket and/or a backpack.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
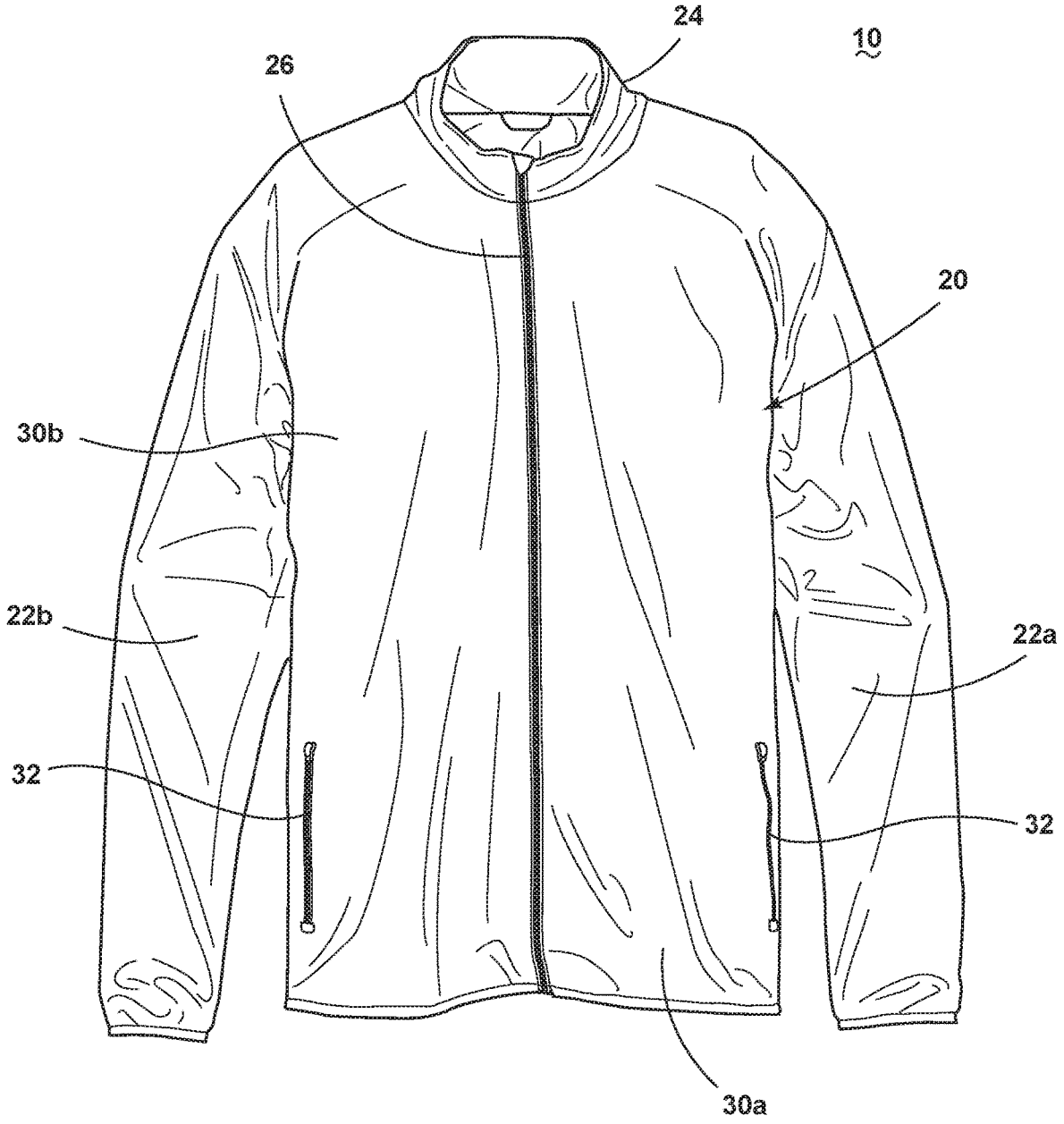
FIG. 1 is a front view of a garment of a current embodiment in a wearing mode.

A current embodiment of the packable garment is illustrated in FIGS. 1-8, and generally designated 10. In the illustrated example, the packable garment is in the form of a jacket and includes a stowage bag 12. The stowage bag 12 is configured to allow the remainder of the garment 10 to be stuffed into the stowage bag 12 for ease of carrying when not being worn. The jacket 10 includes an elongated strap closure 16 to secure the remainder of the jacket 10 within the stowage bag 12, such that the stowage bag 12 can be void of a zipper used to close an opening of the stowage bag 12. Although illustrated in connection with a hooded jacket construction, the present invention can be incorporated into other type of garments, such as sweatshirts, overshirts, t-shirts, parkas, shorts, pants, rain coats, warmups and the like.

In the illustrated embodiment, the jacket 10 is a generally conventional zip-up, hooded jacket. The jacket 10 can include a front zipper 26 closure. The jacket 10 can include other closures or can be a pullover garment, and can include a collar instead of, or in addition to, a hood. Referring now to FIG. 1, the jacket 10 includes a jacket body having a torso portion 20, first and second arm portions, which optionally can be in the form of full length sleeves 22*a-b*, and a hood 24. The torso portion 20 can include a front panel 30 and a back panel 40, each joined with the sleeves 22*a-b*. The torso portion 20 and sleeves 22*a-b* can be of a layered construction, and can include an exterior layer or shell, and can optionally include a lining and insulation (not shown). The shell can be constructed from one or more of polyester taffeta, a polyester woven fabric, such as Versatech®, or any other material suitable for a shell. The lining can be nylon taffeta, a nylon plain weave, polyester tricot, or any other material suitable for a lining and the insulation can be down, synthetic fiberfill or essentially any other garment insulation. The shell, lining, and insulation can be assembled as desired and can include regions of channel quilting or other forms of stitching configured to intersecure the shell, lining, and insulation.

As shown, the jacket 10 can include a variety of accessories, such as pockets, cuffs, and various trim elements. The pockets can include closures, such as zippers, snaps or buttons. The front zipper 26 can be fitted with a storm flap and/or a chin guard. The jacket 10 can include closable vents located in the sides of the jacket 10 to selectively vent the underarm regions of the jacket 10. The closable vents can each include a closure, such as a zipper. Further, the cuffs can be bound by a spandex material, such as Lycra®, or other similar materials to provide a certain amount of elasticity in the cuffs, while at the same time providing a comfortable and durable interface with the wearer's skin. If desired, the lower hem can include one or more drawstrings (not shown).

The front panel 30 of the jacket 10 can be configured to extend over an anterior of a wearer's torso, and the back panel 40 can be configured to extend over a posterior of a wearer's torso, for example, a wearer's back. The front panel 30 includes opposing side portions 30*a*, 30*b* joined via the zipper 26, and each of the side portions 30*a*, 30*b* can optionally include a pocket 32. These pockets optionally can include a zipper closure. The jacket 10 includes a longitudinal axis LA (FIG. 2), and the front and back panels 30, 40 extend across and overlap the longitudinal axis LA.

Figure 2:
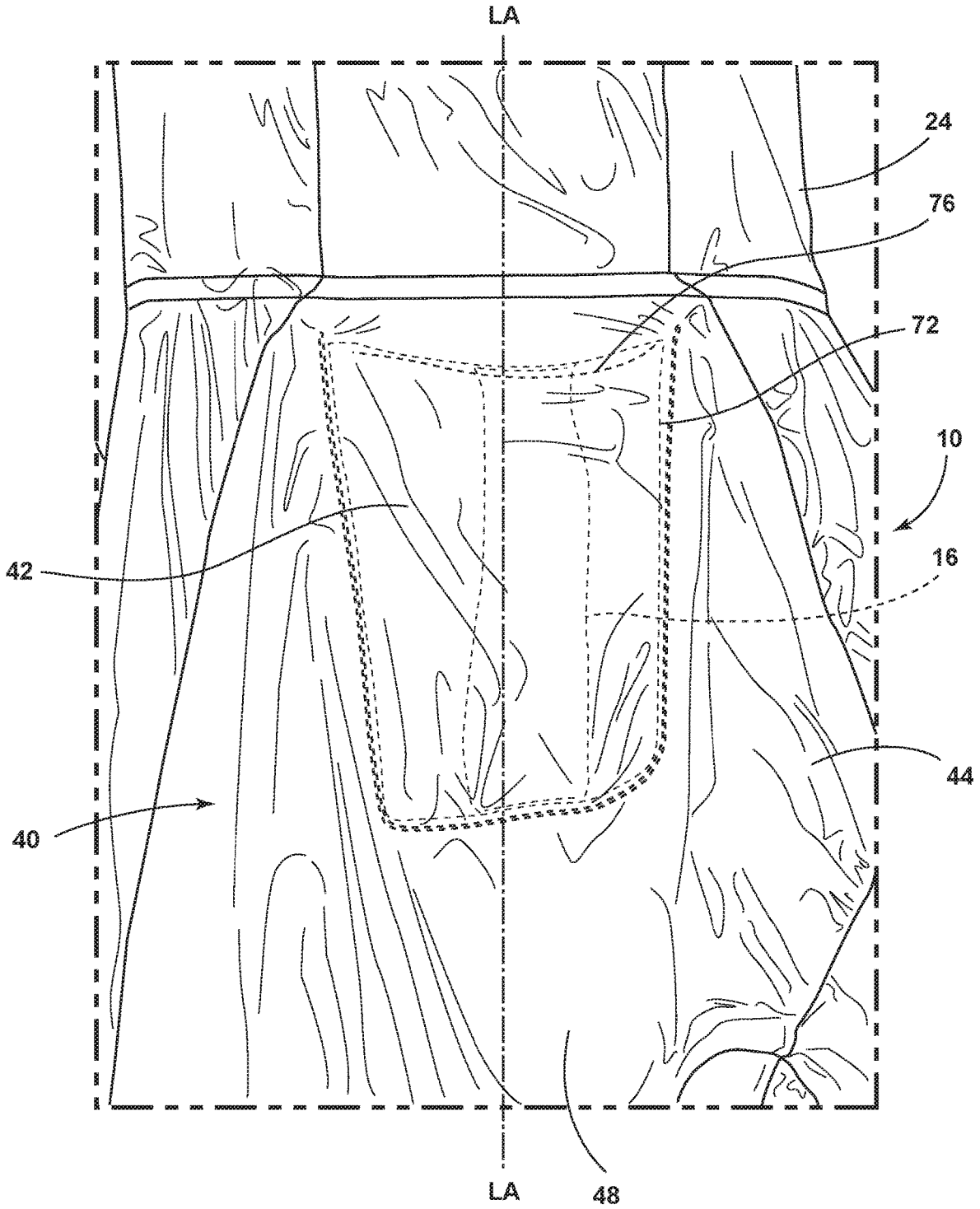
FIG. 2 is a rear view of the garment in the wearing mode.
Figure 3:
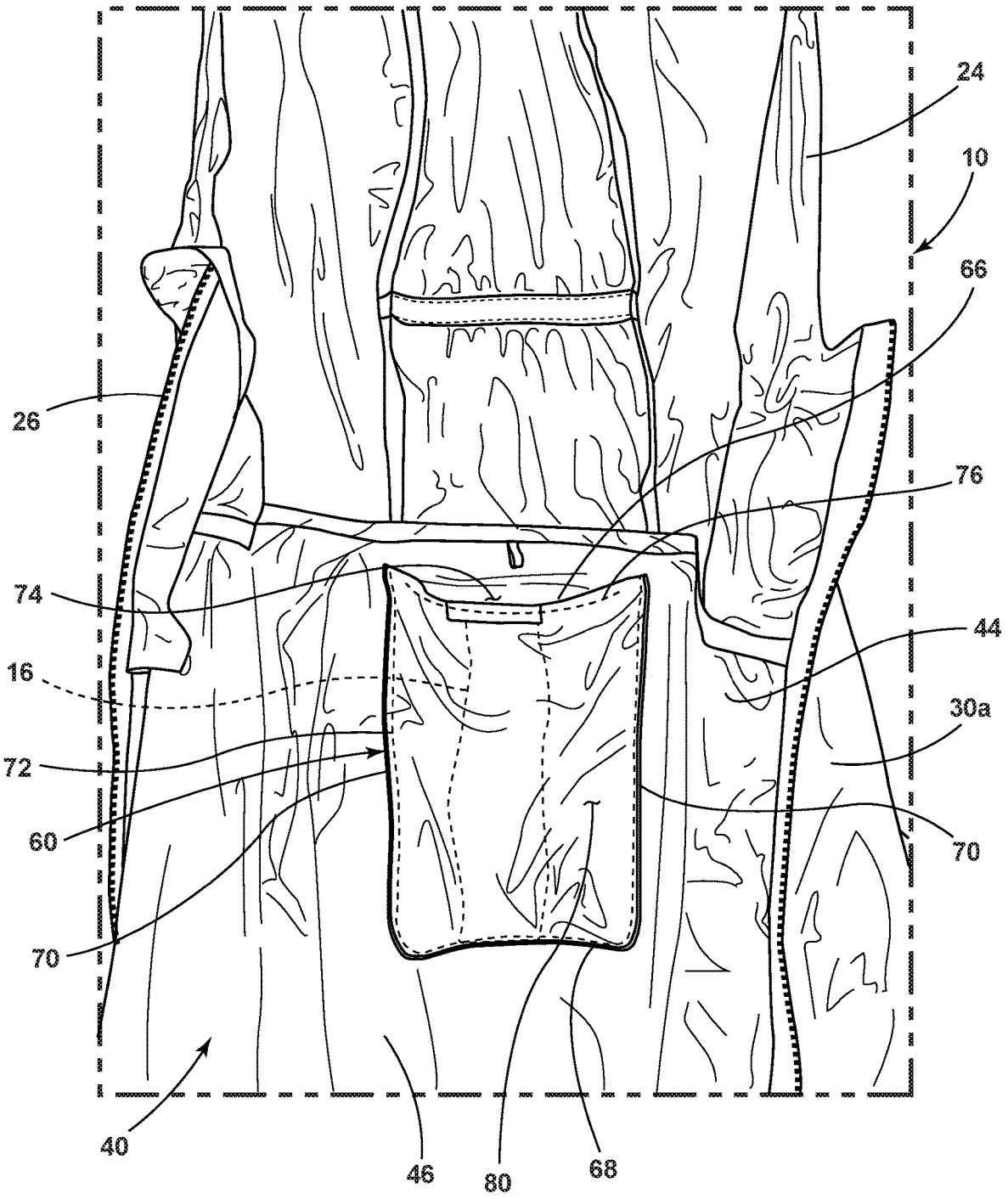
FIG. 3 is a front interior view of the garment illustrating a back panel and a bag panel in the wearing mode.

Referring to FIGS. 2-3, the back panel 40 can include a first back panel portion 42 and second back panel portion 44. The back panel 40 can include a first back panel surface 46 configured to face toward the posterior of the wearer's torso and a second back panel surface 48 configured to face away from the posterior of the wearer's torso. When the jacket 10 is being worn, the first back panel surface 46 can form an interior part of the jacket 10, and the second back panel surface 48 can form an exterior part of the jacket 10. The second back panel portion 44 can include a majority of the back panel 40, while the first back panel portion 42 can overlay a bag panel 60.

The bag panel 60 of the jacket 10 can be positioned on the back panel 40 and located between the two sleeves 22*a-b*, substantially centered on the longitudinal axis LA. The bag panel 60 can define a first bag panel surface 62 configured to face toward the posterior of the wearer, and a second bag panel surface 64 configured to face away from the posterior of a wearer. Optionally, in relation to the stowage bag 12, when the jacket 10 is being worn, the first bag panel surface 62 can be on the exterior surface of the bag 12 (and bag panel 60), and the second bag panel surface 64 can be on the interior surface of the bag 12 (and bag panel 60). A seam 72 can be sewn with stitching around a perimeter of the bag panel 60, with the exception of an upper edge 66 of the bag panel 60. The seam 72 can join a lower edge 68 of the bag panel 60, and opposing side edges 70 of the bag panel 60 to the first portion 42 of the back panel 40, to define a first void 80 therebetween. In this orientation, the first back panel surface 46 faces toward the second bag panel surface 64, and the first void 80 is disposed therebetween. Also, the first portion 42 of the back panel 40 overlaps the bag panel 60. The unsewn (by seam 72) upper edge 66 of the affixed bag panel 60 and the back panel 40 can define an opening 74 to provide access to the first void 80. The opening 74 includes an opening width OW.

Figure 4:
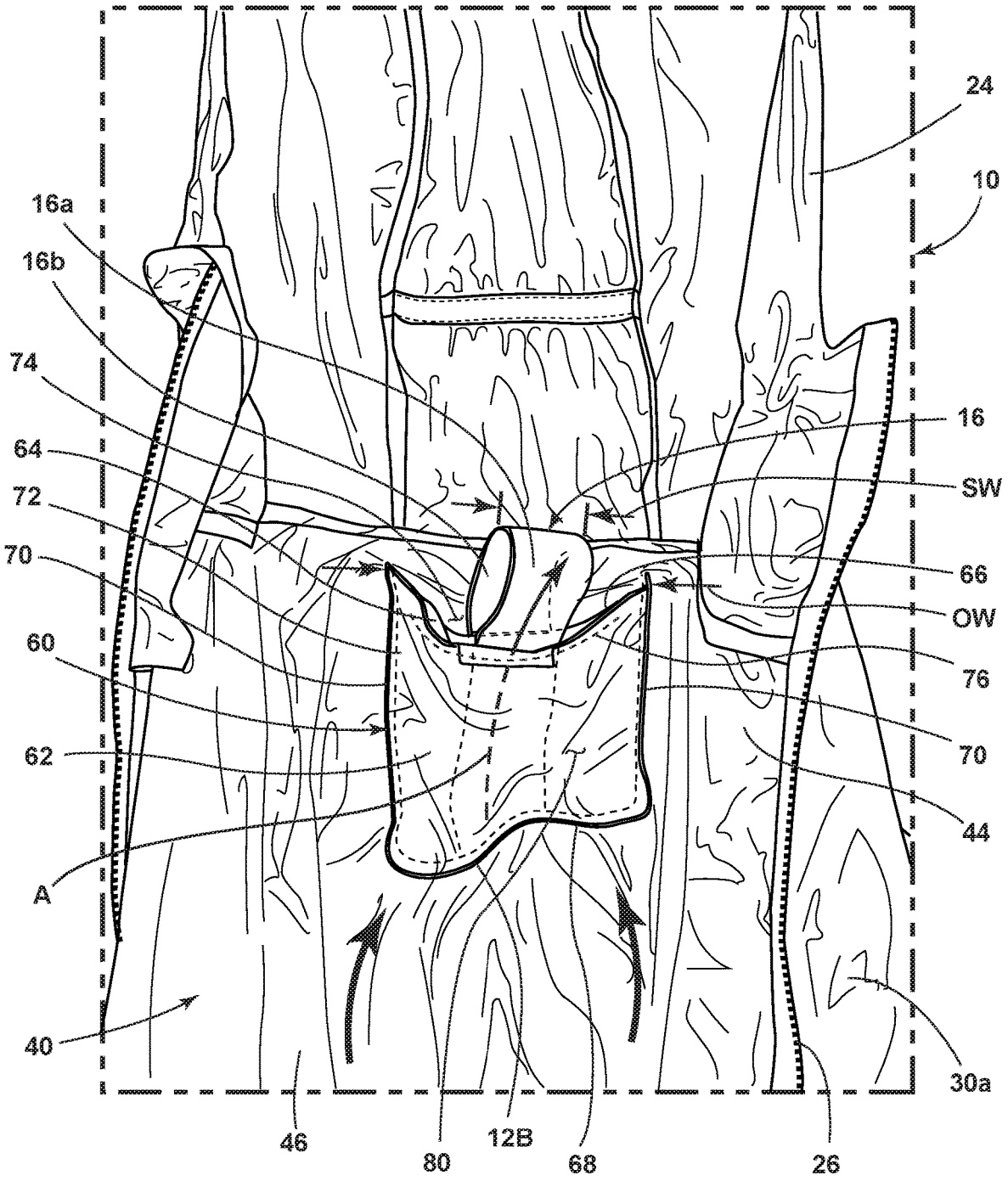
FIG. 4 is a front interior view of the garment with the back panel and a bag panel initially being converted to a stowed mode.
Figure 5:
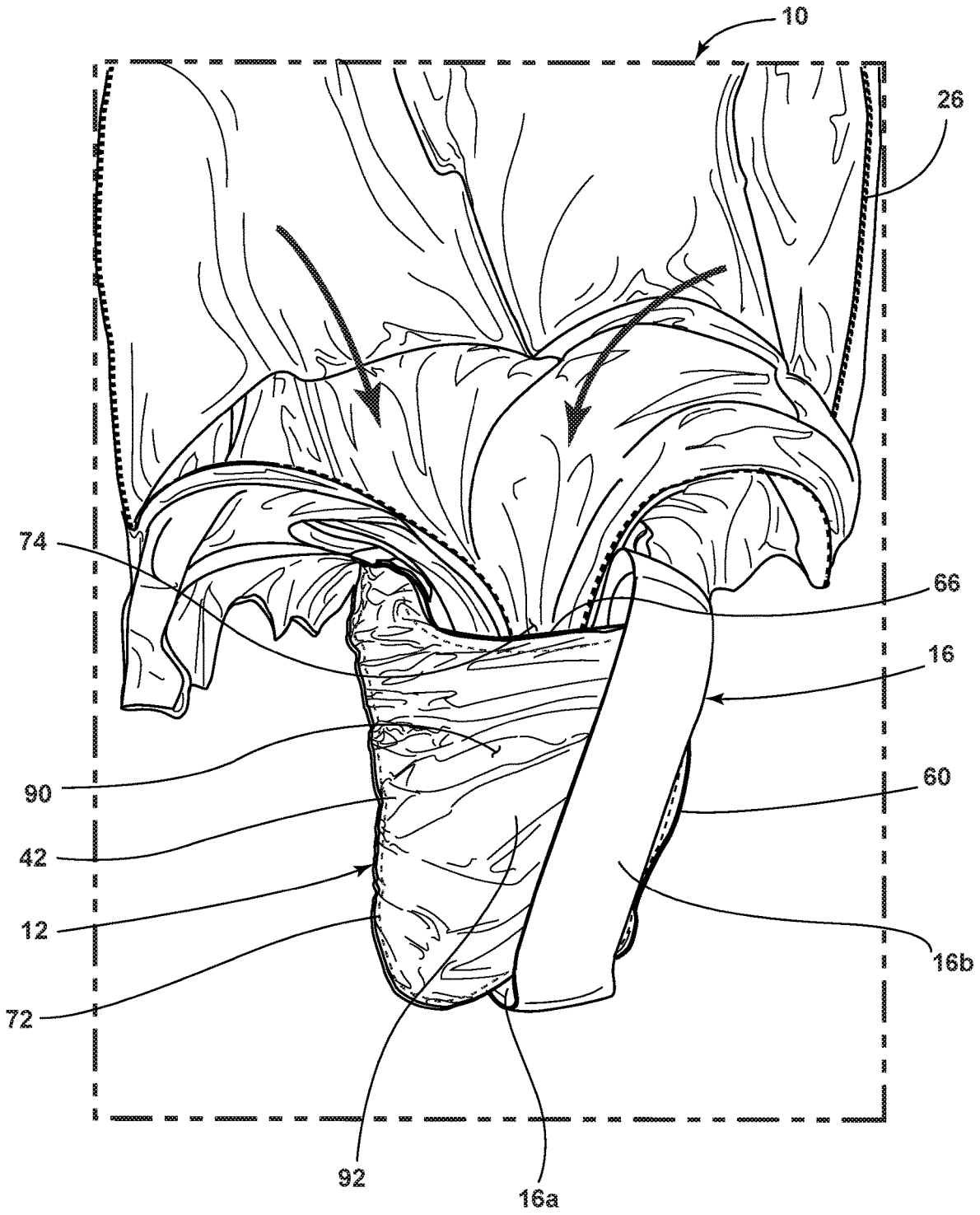
FIG. 5 is a front interior view of the garment with the back panel and a bag panel being further converted to the stowed mode.

Referring to FIGS. 4-5, the elongated strap 16 includes a first side 16*a* and a second side 16*b* and can be joined with the bag panel 60. The strap 16 can be centered along the longitudinal axis LA and parallel to a centerline of the bag panel 60, can extend from the upper edge 66 of the bag panel 60 to the lower edge 68 of the bag panel 60. The strap 16 can be disposed adjacent the second bag panel surface 64. The strap 16 can be joined with the bag panel 60 via a second seam 76 adjacent the opening and upper edge. The strap 16 can be disposed in the first void 80 when the jacket 10 is being worn by the wearer. The seam 76 extends across at least a portion of the upper edge 66 of the bag panel 60, such that stitches of the seam 76 extend through the strap 16 to join the strap 16 to the bag panel 60. The strap 16 includes a strap width SW, and the ratio of the opening width OW to the strap width SW optionally is at least 1.5:1, further optionally at least 2:1, even further optionally about 1.75:1, yet further optionally about 2:1, even further optionally at least between 1.5:1 and 3:1. Alternatively, the strap 16 can cover optionally less than 75% of the opening width, and further optionally less than 50% of the opening width. The strap 16 is of a first length when disposed in the first void 80 and can be constructed of an elastic or otherwise stretchable material, which can enable the strap to stretch to a second greater length.

The jacket 10 is operable in a wearing mode and a stowed mode. In the wearing mode, the stowage bag 12 is in the form of an open-topped pouch disposed between the interior of the torso portion 20 of the jacket 10 and the wearer's back when the jacket 10 is being worn. In the illustrated example, the bag panel 60, which can be reconfigured into the stowage bag 12, is located across the center of the back of the jacket 10, extending across the longitudinal axis LA of the jacket 10. Optionally, the opening width OW is transverse to and intersects generally perpendicularly to the longitudinal axis LA. The bag panel 60 is situated below a base of the hood 24 (or collar) of the jacket 10. For example, the upper edge 66 of the bag panel 60 can be about 1 to 2 inches below the base of the hood 24. Optionally, the upper edge 66 of the stowage bag 12 can be immediately below the base of the hood 24, and further optionally, the upper edge 66 of the stowage bag 12 can be more than 2 inches below the base of the hood 24. The location and orientation of the bag panel 60 and stowage bag 12 can vary from application to application, as desired.

Figure 6:
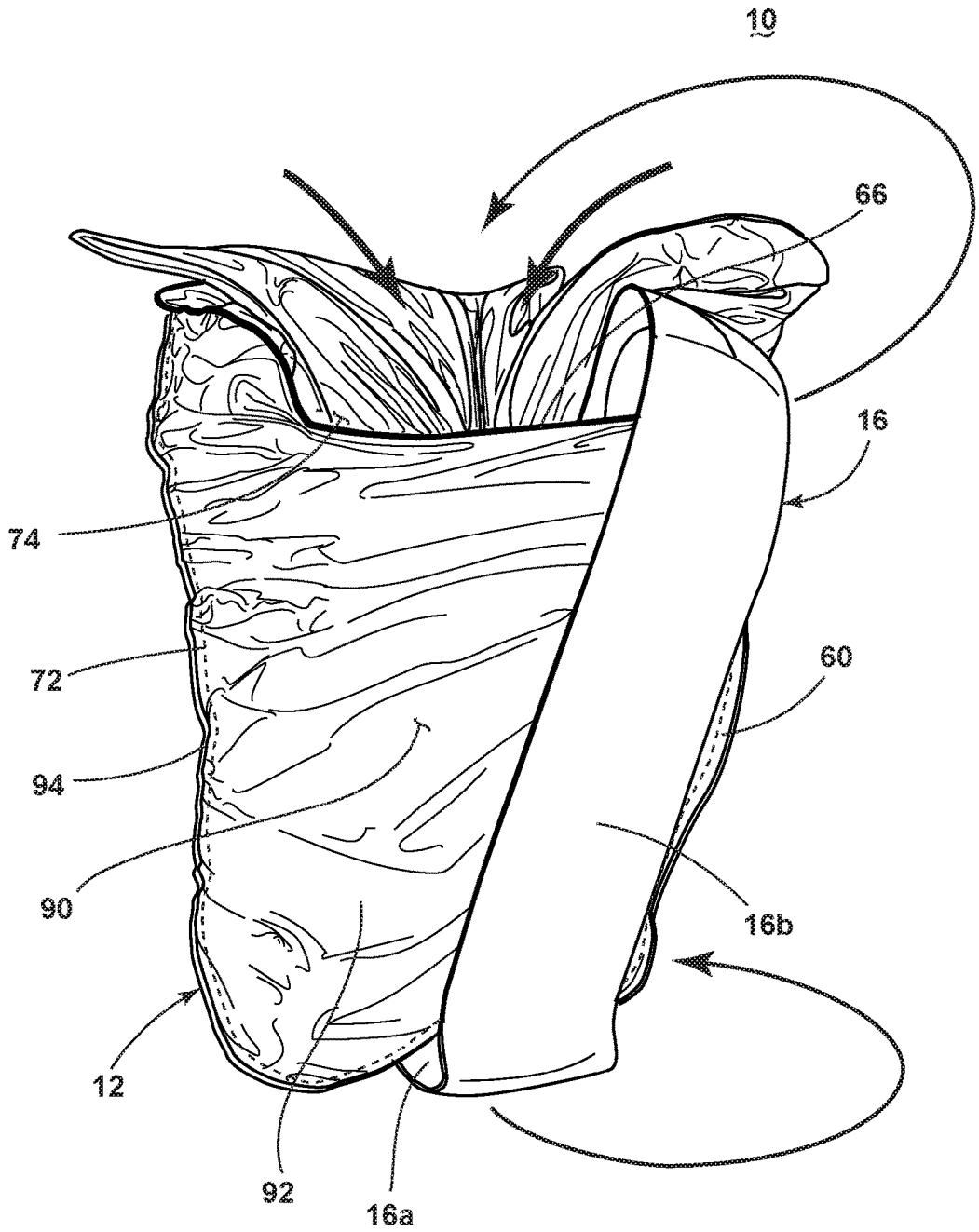
FIG. 6 is a view of the garment with the back panel and a bag panel being even further converted to the stowed mode, before the strap is closed over an opening of the stowage bag.

Referring now to FIGS. 4-6, when converting to the stowed mode, the bag panel 60 and the back panel 40 are first turned inside out. The inside-out bag panel 60 and back panel 40 define a second void 90, which is substantially equivalent to the first void 80 turned inside out. To turn the back panel 40 inside out, the back panel 40 is folded over itself at its first portion 42. Generally, the bottom 12B of the stowage bag 12 is pulled out of the opening 74 in the direction of arrow A in FIG. 4, which turns this item inside out. In the inside-out configuration, the stowage bag 12 forms a pouch oriented such that it can receive the remainder of the jacket 10. In the stowed mode, the second bag panel surface 64 can form a front exterior surface 92 of a stowage bag, referred to as the stowage bag 12, and the first back panel surface 46 can be a rear exterior surface 94 of the stowage bag 12. Also, in this inside-out configuration, the first strap side 16*a* of the strap 16 can be disposed adjacent and can extend over the front exterior surface 92 of the stowage bag 12. The stowage bag 12 can define the opening 74 adjacent the upper edge 66 of the bag panel 60 and a folded over portion of the back panel 40.

Referring to FIGS. 5-6, when converting the jacket 10 from the wearing mode to the stowed mode, bag panel 60 and first portion 42 of the back panel 40 are pulled into the stowage bag 12 in an inside-out configuration. In this configuration, the stowage bag 12 provides a compact stowage back or pouch with an opening 74 that is oriented to receive the remainder of the jacket 10. The remainder of the jacket 10, such as the second portion of the back panel, the front panel, the pockets and the arm portions can be manually stuffed into the stowage bag 12 to fill the stowage bag 12 and store the jacket 10 within the stowage bag 12 without using a zipper.

Figure 7:
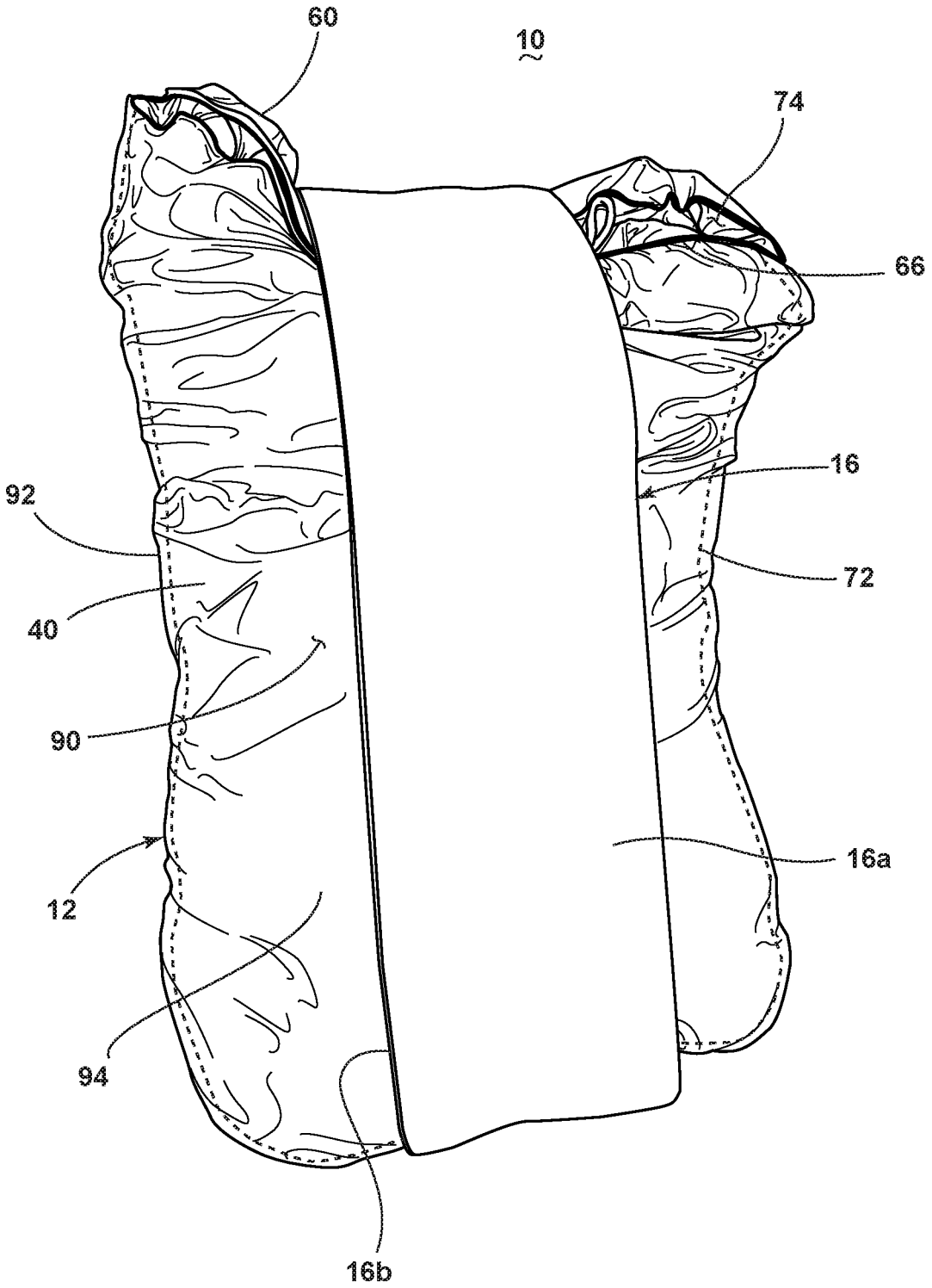
FIG. 7 is a perspective view of the garment in the stowage bag and in the stowed mode.

Referring now to FIGS. 6-7, once the entire jacket 10 is fitted into the stowage bag 12, the strap 16 can be reoriented and flipped to extend over the rear exterior surface 94 of the stowage bag 12 and over the upper edge 66 and the opening 74 of the stowage bag 12. When reorienting the strap 16, the strap 16 can be stretched to a second length, greater than the first length. Once reoriented, the strap seam 76 is turned over and the second strap side 16*b* is disposed adjacent the rear exterior surface 94 of the stowage bag 12. The reoriented strap 16 at least partially closes the opening 74 in the stowed mode. The strap 16 can cover less than about 75% of the opening width, and the remaining portion of the opening width can remain unsecured. The stowage bag 12 can then be carried by the user by placing their hand or arm between the strap 16 and the rear exterior surface 94 of the stowage bag 12, while the strap 16 is stretched. It should be understood that the strap 16 can serve as the element to assist in carrying around the garment, whether in the hand, on the arm, or attached to belt, pocket and/or a backpack. In this manner, the stowage bag 12 can be carried by the user in one hand, without really having to hold onto it. The stowage bag 12 is easily returned to the jacket configuration by reorienting the strap 16 and pulling the jacket 10 out from inside the stowage bag 12.

In the stowed mode, the second portion 44 of the back panel 40, the first and second sleeves 22*a-b*, and the front panel 30 are stuffed into and stored inside the second void 90 of the stowage bag 12. The interior volume of the void 90, which is also the interior volume of the stowage bag 12, and the volume of the jacket 10 can be selected so that the jacket 10 substantially fills the stowage bag 12.

A method of using the packable jacket 10 will now be described. On a high level, the method can include the steps of: (a) wearing the garment described above; (b) removing the garment from the wearer; (c) engaging the bag panel and the first portion of the back panel to turn the back panel and the first portion of the back panel inside out; (d) stuffing the second portion of the back panel into the second void through the opening; (e) stuffing the first and second arm portion and the front panel into the second void through the opening; and (f) reorienting the strap so that the strap extends over the rear exterior surface of the stowage bag, and over the upper edge and the opening of the stowage bag so as to close the opening The method step, illustrated in FIGS. 4-5, of engaging the bag panel 60 and the first portion 42 of the back panel 40 to turn the bag panel 60 and the first portion 42 of the back panel 40 inside out defines the second void 90. Turning the bag panel 60 and the first portion 42 of the back panel 40 inside out renders the second bag panel surface 64 the front exterior surface 92 of the stowage bag 12. This also renders the first back panel surface 46 of the back panel 40 the rear exterior surface 94 of the stowage bag 12. In this inside-out orientation, the strap 16 can extend over the front exterior surface 92 of the stowage bag 12. Also, in this orientation, the stowage bag 12 can define the opening 74 adjacent the upper edge 66 of the bag panel 60.

The method step, illustrated in FIGS. 5-6, of stuffing portions of the jacket 10 into the second void 90 includes stuffing the second portion 44 of the back panel 40 through the opening 74 before the stuffing the front panel 30, and the sleeves 22 into the stowage bag 12. All of the pockets 32 are therefore also stuffed inside the second void 90. In the present configuration, the first portion 42 of the back panel 40 is not stuffed into the second void 90 because the first portion 42 forms part of the stowage bag 12.

The method can include reorienting the strap 16 so that the strap 16 moves from being located over and adjacent the front exterior surface 92 to a position over and adjacent, and extending over the rear exterior surface 94 of the stowage bag 12, as illustrated in FIGS. 6-7. The strap 16 extends over the upper edge 66 and the opening 74 of the stowage bag 12 so as to at least partially close the opening 74. Accordingly, the opening 74 is only closed with the strap 16, and no zipper is utilized.

Figure 8:
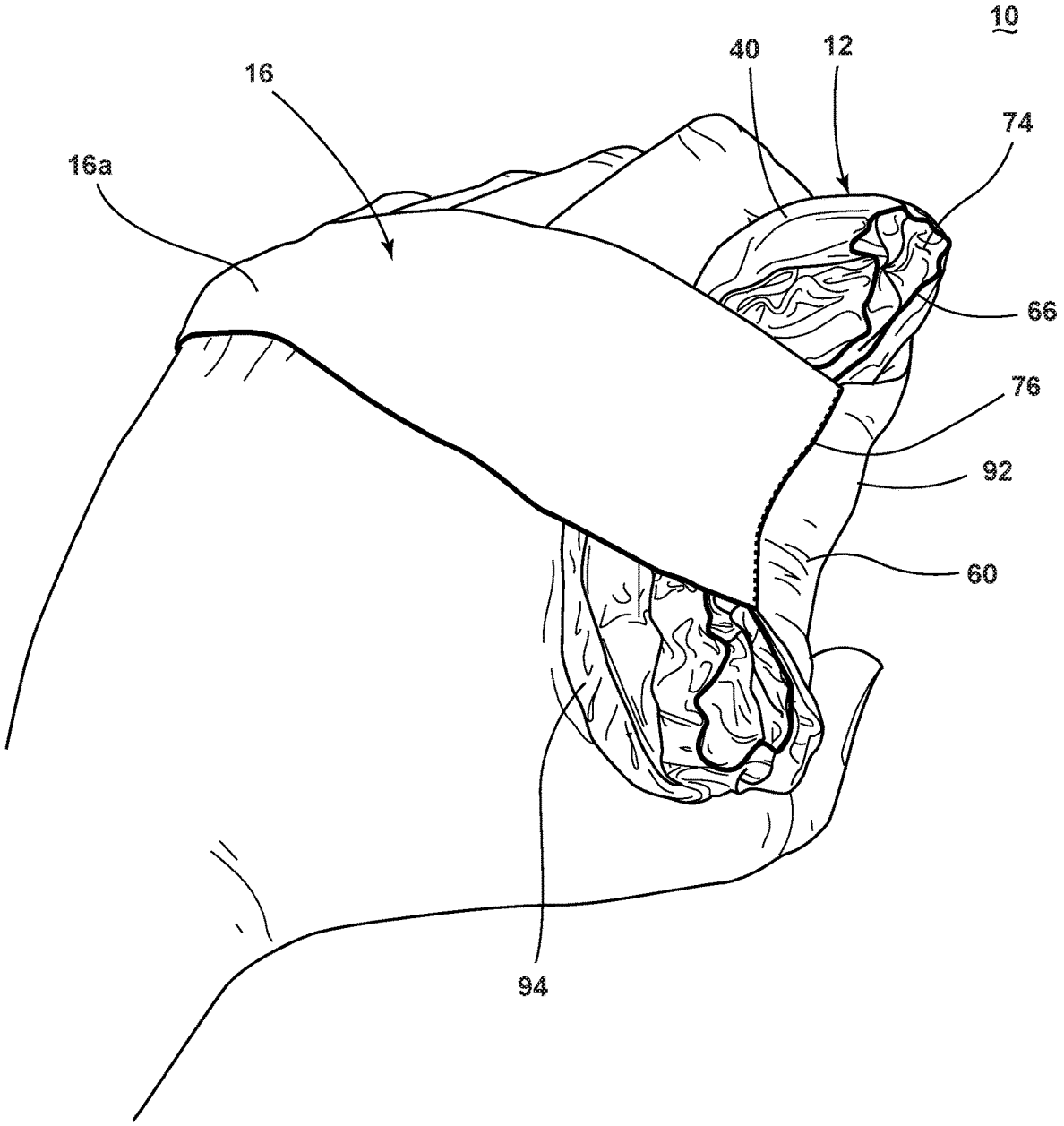
FIG. 8 is a perspective view of the garment in the stowage bag being carried by a user.

The method can include placing a single user's hand between the strap 16 and the rear exterior surface 94 of the stowage bag 12, such that the stowage bag 12 can be carried by the user with the single user's hand, as shown in FIG. 8. Optionally, the stowage bag 12 can be carried or worn on the hand, around the arm, or attached to belt, pocket and/or a backpack.

The above described embodiments of the garment and related method of use provide benefits that previously have been unachievable. For example, with the bag panel 60 joined directly with the back panel 40, the resulting stowage bag 12 can be loaded relatively symmetrically with the remainder of the jacket 10. Because the stowage bag 12 is closed with the elongated strap 16, extra zippers, fasteners, and other bulky closures can be eliminated to simplify the construction. In cases where the strap 16 is elastic, and is placed over the rear exterior surface 94 of the stowage bag 12, the stowage bag 12 can be easily carried by a user by inserting their hand between the strap 16 and the rear exterior surface 94. The strap 16 can form the final and only closure after the jacket 10 has been stuffed into the stowage bag 12. The strap 16 also can serve as the element to assist in carrying the garment, whether in the hand, on the arm, or attached to belt, pocket and/or a backpack.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A method of using a garment comprising:

wearing the garment including a longitudinal axis, first and second arm portions, a front panel extending over an anterior of a wearer's torso and a back panel extending over a posterior of a wearer's torso, the back panel including a first back panel portion and a second back panel portion, the garment including a bag panel located between the first and second arm portions, the bag panel including a bag panel surface facing toward the posterior and a second bag panel surface facing away from the posterior, the back panel including a first back panel surface facing toward the posterior and a second back panel surface facing away from the posterior, the first back panel surface facing toward the second bag panel surface, the bag panel being joined with an elongated strap extending from an upper edge of the bag panel to a lower edge of the bag panel, the strap being disposed adjacent the second bag panel surface, the strap being joined with the bag panel via a seam extending around a perimeter of the bag panel, the seam joining the lower edge of the bag panel, and opposing side edges of the bag panel with the first portion of the back panel, to define a first void, with the strap being disposed in the first void when the garment is being worn by the wearer;

removing the garment from the wearer;

engaging the bag panel and the first portion of the back panel so as to turn the bag panel and the first portion of the back panel inside out so as to define a second void, and to render the second bag panel surface a front exterior surface of a stowage bag, and to render the first back panel surface a rear exterior surface of the stowage bag, with the strap extending over the front exterior surface of the stowage bag, the stowage bag defining an opening adjacent the upper edge of the bag panel;

stuffing the second portion of the back panel into the second void through the opening;

stuffing the first and second arm portion and the front panel into the second void through the opening; and reorienting the strap so that the strap extends over the rear exterior surface of the stowage bag, and over the upper edge and the opening of the stowage bag so as to close the opening, whereby the second portion of the back panel, the first and second arm portion and the front panel are stowed in the second void.

2. The method of claim 1 comprising:

stuffing the second portion of the back panel through the opening before the front panel, the first arm portion and the second arm portion.

3. The method of claim 2, comprising:

closing the opening only with the strap extending over the upper edge and the opening of the stowage bag, wherein the strap includes a strap width, wherein the opening includes an opening width, wherein the ratio of the opening width to the strap width is at least 1.5:1.

4. The method of claim 3, wherein the strap overlays the longitudinal axis before the reorienting step.

5. The method of claim 4, wherein the garment includes a plurality of pockets, wherein all of the pockets are stuffed inside the second void.

6. The method of claim 1, wherein the first portion overlaps the bag panel, and comprising not stuffing the first portion in the second void because the first portion forms part of the stowage bag, wherein the front panel includes opposing side portions joined via a zipper closure, wherein each of the opposing side portions includes a respective pocket.

7. The method of claim 1, comprising:

placing a single hand of a user between the strap and the rear exterior surface of the stowage bag, whereby the stowage bag can be carried by the user.

8. The method of claim 1, wherein the strap includes a first side and a second side, wherein the first strap side is disposed adjacent the front exterior surface before the reorienting step, wherein the second strap side is disposed adjacent the rear exterior surface after the reorienting step.

9. The method of claim 1, wherein the stowage bag defines a volume that is greater than or equal to a compressed volume of the garment when the garment is stuffed into the stowage bag.

10. A method of using a garment comprising:

providing the garment including a longitudinal axis, first and second arm portions, a front panel configured to extend over an anterior of a wearer's torso and a back panel configured to extend over a posterior of a wearer's torso, the back panel including a first back panel portion and a second back panel portion, the garment including a bag panel with a bag panel surface configured to face toward the posterior and a second bag panel surface configured to face away from the posterior, the back panel including a first back panel surface configured to face toward the posterior and a second back panel surface configured to face away from the posterior, the first back panel surface facing toward the second bag panel surface, the bag panel being joined with an elongated strap extending adjacent the second bag panel surface within a first void between the second bag panel surface and the first back panel surface;

engaging the bag panel and the back panel so as to turn the bag panel and the back panel inside out so as to define a second void, and to render the second bag panel surface a front exterior surface of a stowage bag, and to render the first back panel surface a rear exterior surface of the stowage bag, with the strap extending over the front exterior surface of the stowage bag, the stowage bag defining an opening;

stuffing the garment into the second void; and reorienting the strap so that the strap extends over the rear exterior surface of the stowage bag, and over the opening of the stowage bag so as to at least partially close the opening.

11. The method of claim 10, wherein the opening includes an opening width, wherein the strap covers less than 75% of the opening width, wherein a remaining portion of the opening width remains unsecured.

12. The method of claim 11, wherein the opening is defined by an upper edge of the bag panel and a folded over portion of the back panel.

13. The method of claim 12, wherein the upper edge of the bag panel includes a seam, wherein the seam includes a stitch extending through the elongated strap, wherein the seam is turned over during the reorienting step.

14. The method of claim 13 comprising:

wherein the strap includes a first side and a second side, wherein the first strap side is disposed adjacent the front exterior surface before the reorienting step, wherein the second strap side is disposed adjacent the rear exterior surface after the reorienting step.

15. The method of claim 14, wherein the upper edge of the bag panel is disposed 1 to 2 inches below an upper edge of the back panel.

16. The method of claim 10, wherein the elongated strap is an elastic strap, wherein the strap is of a first length when disposed in the first void, wherein the strap is stretched to a second length greater than the first length during the reorienting step.

17. The method of claim 16 comprising:

placing a hand between the strap and the rear exterior surface of the stowage bag, while the strap is stretched.

* * * * *